US011338358B2

(12) United States Patent
Aspacher et al.

(10) Patent No.: US 11,338,358 B2
(45) Date of Patent: May 24, 2022

(54) DIECASTING TOOL SYSTEM

(71) Applicant: Oskar Frech GmbH + Co. KG, Schorndorf (DE)

(72) Inventors: Ronny Aspacher, Schorndorf (DE); Marco Beier, Schorndorf (DE); Nikolai Clauss, Rudersberg (DE)

(73) Assignee: Oskar Frech GmbH + Co. KG, Schorndorf (DE)

( * ) Notice: Subject to any disclaimer, the term of this patent is extended or adjusted under 35 U.S.C. 154(b) by 0 days.

(21) Appl. No.: 17/307,637

(22) Filed: May 4, 2021

(65) Prior Publication Data

US 2021/0346946 A1 Nov. 11, 2021

(30) Foreign Application Priority Data

May 5, 2020 (DE) ..... 10 2020 205 645.5
Feb. 10, 2021 (EP) ..... 21156196

(51) Int. Cl.
*B22D 17/22* (2006.01)

(52) U.S. Cl.
CPC ..... *B22D 17/229* (2013.01); *B22D 17/2218* (2013.01); *B22D 17/2236* (2013.01)

(58) Field of Classification Search
CPC ..... B22D 17/22; B22D 17/229; B22D 17/24; B22D 17/2218; B22D 17/2236; B22C 9/06

(Continued)

(56) References Cited

FOREIGN PATENT DOCUMENTS

CN 108746543 A 11/2018
DE 3542840 C2 7/1989

(Continued)

OTHER PUBLICATIONS

Queudeville, Y., "Entwicklung einer Methodik zur Modularisierung von Druckgusswerkzeugen", Ergebnisse aus Forschung und Entwicklung, 2015, vol. 19 (2015), Giesserei-Institut der RWTH Aachen, ISBN 978-3-944601-08-3 (Ebook), (195 pages).

(Continued)

*Primary Examiner* — Kevin P Kerns
(74) *Attorney, Agent, or Firm* — Crowell & Moring LLP

(57) ABSTRACT

A diecasting tool system has a machine-related base plate, at least one set of contour-imparting mould components which in an assembled position on the base plate form a casting contour for an associated cast part to be cast, and a plurality of not contour-imparting tool receptacle module components. The base plate, the tool receptacle module components and the contour-imparting mould components are configured for releasably assembling the associated set of contour-imparting mould components and an assigned set of the tool receptacle module components on a fastening side of the base plate for casting the respective cast part. The base plate on the fastening side has a fastening grid of a plurality of fastening points which are disposed so as to be distributed in a regular or irregular pattern across a fastening region. The set of contour-imparting mould components conjointly with the assigned set of the tool receptacle module components is able to be assembled on the base plate in at least two different orientations, and/or a plurality of sets of contour-imparting mould components with a respectively assigned set of the tool receptacle module components are present for selective assembling on the base plate.

16 Claims, 4 Drawing Sheets

(58) Field of Classification Search
USPC ..... 164/339, 341, 342, 344
See application file for complete search history.

(56) References Cited

FOREIGN PATENT DOCUMENTS

| | | | |
|---|---|---|---|
| DE | 10 2014 103 532 | A1 | 9/2015 |
| DE | 10 2015 015 368 | A1 | 5/2016 |
| DE | 20 2015 101 713 | U1 | 8/2016 |
| DE | 10 2012 019 357 | B4 | 5/2017 |
| DE | 10 2016 121 996 | A1 | 5/2018 |
| DE | 10 2016 011 581 | B4 | 6/2018 |
| WO | WO 2017/142731 | A1 | 8/2017 |
| WO | WO 2018/096565 | A1 | 5/2018 |

OTHER PUBLICATIONS

German-language Office Action issued in German Application No. 10 2020 205 645.5 dated Nov. 18, 2020 with (eight (8) pages).
European Search Report issued in European Application No. EP 21 15 6196 dated Jul. 9, 2021 with partial English translation (nine (9) pages).

DIECASTING TOOL SYSTEM

CROSS REFERENCE TO RELATED APPLICATIONS

This application claims priority under 35 U.S.C. § 119 from German Patent Application No. 102020205645.5, filed May 5, 2020, and European Patent Application No. 21156196.4, filed Feb. 10, 2021, the entire disclosures of which are herein expressly incorporated by reference.

BACKGROUND AND SUMMARY OF THE INVENTION

The invention relates to a diecasting tool system for a diecasting machine for casting cast parts. The term diecasting herein is to be interpreted in a wide context such that said term comprises in particular both metal diecasting as well as plastic injection-moulding. The term cast part is presently not primarily used for referring to the individual cast parts but as a generic term for describing cast parts of identical design, that is to say that two cast parts differ in each case in terms of their design. For differentiation, individually cast parts in contrast are presently referred to as cast products.

In conventional diecasting systems there is a close correlation between the cast part and the diecasting tool system specifically produced for said cast part. This means that the vast majority of components of conventional diecasting tool systems are specially made only for this cast part to be cast and conjointly assembled so as to form the diecasting tool system, also referred to as diecasting tool for short, that is specific to this cast part. This applies even in the case of relatively minor deviations of the cast parts from one another, for example to the casting of parts which are similar but not identical in terms of shape, such as when producing variants of parts by casting. The costs of conventional diecasting tools are correspondingly high, this in turn rendering the casting of cast parts in relatively small numbers or in different variants, such as to produce prototypes and low volumes by diecasting, comparatively cost-intensive. Moreover, the corresponding tooling and retooling of the diecasting tool causes an interruption of the casting operation during the tooling procedure, this compromising the eco-nomic viability.

The typical conventional diecasting tool system herein includes two mould halves, that is to say one movable and one non-movable mould half, and for each of these two mould halves in each case one mould frame and insert parts which can be established on the mould frame and which comprise contour-imparting mould components as well as not contour-imparting mould components. The mould frame and the mould components as insert parts are individually adapted to the cast part to be cast and therefore typically specified and suitable for casting only this one cast part. The contour-imparting mould components in an assembled position on the mould frame form a casting contour for the cast part to be cast, that is to say that said contour-imparting mould components determine the contour of a casting cavity which corresponds to the shape of the cast part and which in the casting procedure is filled with an associated casting material, such as a liquid metal melt or a molten plastics material, which is supplied under pressure. For example, guide components, ventilation components and slider components are part of the not contour-imparting mould components. Slider components are used in particular for casting cast parts which have undercuts and similar contours and do not enable direct demoulding, and typically comprise slider supports which are assembled so as to be immovable and slider guides which are assembled so as to be movable thereon.

Conventional diecasting tool systems of this type are disclosed, for example, in patent publication DE 10 2012 019 357 B4 as well as the laid-open publications DE 10 2014 103 532 A1 and WO 2017/142731 A1. In DE 10 2012 019 357 B4 herein, a diecasting tool system having a special slider guide which is disposed on a mould plate is disclosed. In DE 10 2014 103 532 A1, a diecasting tool system is disclosed which is specially conceived for casting a support structure of an oil filter module for an internal combustion machine, said support structure being the cast part to be cast, and a diecasting tool system which is specially conceived for casting metallic components for applications in vehicles is disclosed in WO 2017/142731 A1, said diecasting tool system herein using replaceable insert parts as contour-forming mould components in areas having a particular stress in terms of wear or erosion, respectively.

A procedure for modularizing diecasting tools in order to be able to improve the development process of diecasting tools is demonstrated in a theoretical analysis in the dissertation paper by Yann Queudeville, "Entwicklung einer Methodik zur Modularisierung von Druckgusswerkzeugen", Ergebnisse aus Forschung and Entwicklung, vol. 19 (2015), GieBerei-Institut der RWTH Aachen, ISBN 978-3-944601-08-3 (Ebook).

Patent publication DE 35 42 840 C2 discloses a moulding tool for plastics injection-moulding in which mould inserts are received in a mould plate, wherein a central mould insert is fixedly connected to the mould plate while laterally adjoining mould inserts are said to be easily replaceable, especially by releasing wedge bars which are screwed to the mould plate, and may have different sizes and shapes, wherein differences in relation to the maximum length or width of the mould are compensated for by compensation pieces.

Utility model publication DE 20 2015 101 713 U1 discloses a diecasting mould which is said to be specially suitable for the rapid production of prototypes and to this end has two mould halves which receive in each case at least one mould insert having contour parts and optionally filler pieces in a cavity, and have an annular guiding and holding contour which surrounds the cavity, wherein one or a plurality of holders for sliders are disposed so as to be adjustable on the one guiding and holding contour, and locking parts are disposed on the other guiding and holding contour, said locking parts being aligned in a manner corresponding to that of the sliders and in the case of a closed mould locking the sliders or the holders of the latter, respectively, in a set nominal position.

Laid-open publication DE 10 2015 015 368 A1 discloses a casting mould which is intended for the production of different variants of construction of a cast part such as a mounting block for a driver's cab mounting of a commercial vehicle, and to this end has a base mould having a receptacle and a casting mould insert which in the receptacle can be disposed selectively in a first rotary position for producing a first variant of construction, and in a second rotary position, different from the first rotary position, for producing a second variant of construction of the cast part. A selective positioning of the casting mould insert in each case in one of two positions rotated by 180° is especially disclosed, to which end a corresponding point symmetry or mirror symmetry of the participating casting mould components is required.

Laid-open publication DE 10 2016 121 996 A1 discloses a tool element for a tool for plastics injection-moulding in a configuration by way of which servicing and replacing individual components of functional units of the tool element is to be simplified. To this end, the tool element in one embodiment as an ejector-sided tool half comprises a first functional unit which is formed by a mould insert and an ejector installation which is able to be mounted on the rear side of said mould insert while optionally interposing a support plate, and a second functional unit which includes a first holding plate, a second holding plate, a compression plate and a clamping plate. The first and the second functional unit are releasably connected to one another by a locking mechanism which in a mechanically releasable manner couples the ejector installation and the mould insert to the second functional unit, wherein said locking mechanism can be unlocked by means of a user-activatable unlocking bar which is disposed laterally on the tool half.

It is an object of the invention to provide a diecasting tool system which in comparison to the conventional diecasting tool systems mentioned above enables efficient, flexible and cost-effective casting of cast parts also in relatively low volumes and/or in a plurality of different cast part variants.

The invention achieves this and other objects by providing a diecasting tool system which comprises a machine-related base plate, at least one set of contour-imparting mould components which in an assembled position on the base plate form a casting contour for a respective associated cast part to be cast, and a plurality of not contour-imparting tool receptacle module components. The base plate, the tool receptacle module components and the contour-imparting mould components are configured for releasably assembling the associated set of mould components and an assigned set of the tool receptacle module components on the base plate, more specifically on a respective fastening side of the latter for casting the respective cast part.

The term machine-related herein means that the base plate is configured for the specific use on an associated diecasting machine, that is to say for use on a specific model or type, respectively, or on a specific machine size of the diecasting machine, respectively. For a diecasting machine of another size or another type, respectively, another base plate which is correspondingly adapted in a different manner to this other machine is used.

The respective set of contour-imparting mould components determines the shape of the casting cavity and to this end is correspondingly determined or defined, respectively, by the contour of the cast part as is known per se in principle for conventional diecasting tools. In other words, each cast part, that is to say each casting cavity, is assigned a specific set of contour-imparting mould components, and each contour-imparting mould component is specially adapted to this cast part and is typically capable to be used for casting only this cast part but not for casting other cast parts. The contour-imparting mould components of a set associated with a specific cast part herein conjointly form the corresponding mould insert for this cast part, that is to say that said contour-imparting mould components in the assembled state, or in the assembled state thereof on the base plate, respectively, have the function of the mould insert as is well known to the person skilled in the art. The different cast parts to be cast on an identical diecasting machine while using the diecasting tool system according to the invention can differ in particular in terms of the shape and/or the size thereof, wherein the shaping and the size of said cast parts are practically not subject to any restrictions as long as said shaping and size are compatible with the machine size or the size of the base plate, respectively.

In a manner which is likewise commonplace per se, the not contour-imparting tool receptacle module components function as additional tool receptacle components or auxiliary tool parts, respectively, so as to inter alia reliably hold the contour-imparting mould components on the base plate and to ensure that the casting mould overall withstands the compressive stresses in the diecasting procedure, and so as to suitably guide and/or temperature-control the flow of melt material, and ensure the necessary ventilation of the casting cavity, and to enable or to facilitate, respectively, the demoulding procedure depending on the contour of the cast part. As opposed to the above-mentioned conventional systems however, the not contour-imparting tool receptacle components are presently conceived so as to be modular and usable in a correspondingly variable manner, which is why said not contour-imparting tool receptacle components are referred to as tool receptacle module components.

The base plate on the fastening side has a fastening grid of a plurality of fastening points which are disposed so as to be distributed in a regular or irregular pattern across a fastening region. This means that the fastening points in the fastening region are disposed in a two-dimensional grid pattern so as to be mutually offset in two perpendicular or otherwise non-parallel oblique directions, preferably at regular, uniform spacings, alternatively at irregular spacings, in the one and/or the other of the two non-parallel grid directions. The base plate thus comprises a plate body which is embodied as a grid plate and which has the fastening points in the corresponding grid pattern. The fastening points can in particular be formed by corresponding fastening bores which can receive fastening bolts or other fastening means which are conventionally used for fastening purposes in diecasting tools. Alternatively, at least part of the fastening points can be formed by fastening bolts or fastening pins which interact with corresponding mating fastening means on the components to be assembled, such as the contour-imparting mould components, for example. Depending on the requirement, the fastening region can extend across the entire or almost the entire extent of the fastening side, or alternatively extend only over a partial region of the latter. Thanks to this fastening grid, the contour-imparting mould components for a respective cast part and the associated not contour-imparting tool receptacle module components can be fixed in a very flexible manner in a variable orientation and/or in a variable position and/or in a variable size and/or in a variable combination on the base plate. The fastening side, more specifically the fastening region thereof, respectively, according to the definition forms that plate plane of the base plate that serves for fastening the mentioned components.

It is understood that the above enumeration of components of the diecasting tool system is not intended to be exhaustive but is intended to be an indication of the components which are assigned to one of the two mould halves of the diecasting machine, that is to say to the movable or to the fixed, immovable mould half, and which are at least required in order for the invention to be implemented. Depending on the requirement and the specific application, the diecasting tool system according to the invention additionally comprises further components which can be of conventional type or of a new type designed especially for the invention. In particular, the diecasting tool system can comprise a further base plate and/or further contour-imparting mould components and/or further not contour-imparting tool receptacle module components in an embodiment according to the invention or a conventional embodiment for use on the respective other of the two mould halves.

According to one aspect of the invention, the at least one set of contour-imparting mould components conjointly with the assigned set of the tool receptacle module components is capable to be assembled in at least two different orientations and/or in at least two mutually displaced positions on the base plate, that is to say on the fastening side of the latter, that is to say in two or three or any arbitrary other number of more than three different orientations or displaced positions, respectively. The term orientation herein means in particular the rotary position of the contour-imparting mould components and the tool receptacle module components on the fastening side of the base plate; the term position means in particular the translatory or transverse, respectively, position on the fastening side of the base plate. In other words, two different orientations transition into one another primarily on account of a rotation about a rotation axis which is perpendicular to the plate plane of the fastening side, wherein the rotation axis preferably lies within a region across which the construction formed by the contour-imparting mould components and the tool receptacle module components extends on the fastening side of the base plate, while two different positions primarily transition into one another on account of a displacement in a translatory direction which is parallel to the plate plane of the fastening side. The fastening grid formed on the fastening side of the base plate achieves an optimum prerequisite with a view to this variable assembling potential of the mould components and of the tool receptacle module components on the fastening side of the base plate being able to be implemented in a functionally reliable manner which is advantageous in terms of construction.

This aspect of the invention enables the contour-imparting mould components and the not contour-imparting tool receptacle module components to be fastened to the base plate in an orientation or position, respectively, which is optimal for the respective cast part to be cast. The optimal position or orientation, respectively, of the cast part in the diecasting mould is determined inter alia by the geometry of the cast part and the requirement to be able to demould undercuts, in as far as present, to which end slider components having slider guides which have suitable displacement directions are typically used. Further parameters for establishing the optimal orientation and/or the optimal position of the cast part in the casting mould are the design of the infeed of the melt material which is optimized in terms of production technology and the so-called gates, that is to say an optimization of the duct system for the melt material to flow into the casting cavity, that is to say into the mould cavity. Depending on the cast part to be cast, an alignment of the displacement direction of the slider components or slider guides, respectively, which is parallel to the horizontal or vertical machine direction of the diecasting machine may be favourable to this end in one case, for example, whereas in another case a non-parallel, oblique alignment of the slider component displacement direction relative to the horizontal or vertical, respectively, machine direction may be favourable for the casting of another cast part.

Using this aspect of the invention, it is possible to meet these optimization requirements in a flexible and thus efficient manner very simply in that the set of contour-imparting mould components and the assigned set of tool receptacle module components can be fastened to the base plate in the orientation or position, respectively, which is in each case most favourable for the respective case.

According to a further aspect of the invention, which in corresponding embodiments of the invention is implemented additionally or alternatively to the afore-mentioned aspect of the invention, a plurality of sets of contour-imparting mould components with a respectively assigned set of the tool receptacle module components are present for selective assembling on the base plate.

This aspect of the invention enables the casting of two or more different cast parts, that is to say cast parts of different shape and/or size, while using the same diecasting machine with the same base plate. In order for the respective cast part to be cast, that set that is associated with this cast part is selected from the available sets of contour-imparting mould components, and the selected set of contour-imparting mould components, conjointly with the assigned set of the tool receptacle module components, is fastened to the base plate.

As opposed to the above-mentioned conventional diecasting tool systems, in the present invention the base plate conjointly with the contour-imparting mould components and not contour-imparting tool receptacle module components that are adapted so as to match said base plate are thus configured for releasably holding in each case the set of contour-imparting mould components associated with the current cast part to be cast and an assigned set of the tool receptacle module components in a variable manner in a multiplicity of different potential configurations, if required at different orientations and/or positions on the base plate, more specifically on the fastening side of the latter.

In the invention, the base plate, in combination with the contour-imparting mould components and not contour-imparting tool receptacle module components that are assembled as a function of the cast part, replaces the mould frame with insert parts such as is used in the above-mentioned conventional systems and differs from the latter in terms of the capability of said base plate to be able to hold the contour-imparting mould components and the not contour-imparting tool receptacle module components in at least two different configurations, be it in two or more different orientations or positional constellations, respectively, of the same contour-imparting mould components and not contour-imparting tool receptacle module components that are used for casting a specific cast part, be it in constellations having different sets of contour-imparting mould components and assigned not contour-imparting tool receptacle module components for casting different cast parts. As opposed thereto, the mould frame in the mentioned conventional systems is typically conceived for only holding a very specific set of the tool components for casting an assigned cast part; another mould frame having other tool components or insert parts, respectively, held thereon is used for casting another cast part.

The invention in this way enables an efficient and flexible use of an identical base plate for casting different cast parts and/or for casting a cast part in a positional configuration which is in each case optimally adapted in terms of the orientation of the diecasting tool or the diecasting machine, respectively. Moreover, at least part of the not contour-imparting tool receptacle module components when required can be used flexibly and efficiently in a modular manner for casting different cast parts, or for casting in different positional orientations of the cast part or the casting cavity, respectively. The fastening grid can be readily configured in such a manner that said fastening grid enables a relatively large number of different positionings of the respective set of contour-imparting mould components and the assigned set of tool receptacle module components in a mutually displaced and/or rotated manner, and likewise the use of sets of contour-imparting mould components and assigned sets of tool receptacle module components for cast parts that are not only different in terms of their sizes or related in terms of symmetry, but are of an entirely different shape.

In a refinement of the invention, the fastening grid is formed by a two-dimensional field of the fastening points in which field the fastening points are disposed in a plurality of successive parallel rows which are mutually spaced apart in a row spacing direction which is not parallel, that is to say is perpendicular or oblique, to a row direction. This represents an advantageous population of the fastening region by the fastening points, this enabling a high degree of flexibility in terms of the assembling of the contour-imparting mould components and the not contour-imparting tool receptacle module components on the base plate. In an alternative embodiment, the fastening points can be disposed in an irregular, randomly distributed grid pattern, for example.

In a refinement of the invention, a first and a second of the at least two different orientations are rotated in relation to one another about an axis which is perpendicular to the base plate and is situated within the fastening region. This represents an advantageous implementation with a view to the flexible assembling potential of the contour-imparting mould components for a respective cast part and of the assigned set of the tool receptacle module components in different orientations on the base plate. For example, slider components can thus be disposed parallel to the plate plane of the base plate, having different displacement directions relative to the horizontal or vertical, respectively, machine direction, depending on the cast part to be cast, so as to enable an optimal position or orientation, respectively, of the casting cavity while taking into account all casting conditions. In an alternative embodiment, said rotation axis runs outside the fastening region.

In a refinement of the invention, at least one of the not contour-imparting tool receptacle module components is associated with at least two of the sets of the tool receptacle module components. This aspect of the invention increases the efficiency and flexibility of the diecasting tool system in that the tool receptacle module component or the respective tool receptacle module components can be used for casting not only a single specific cast part but can be used for the casting of two or more different cast parts.

As extreme cases, these possibilities include that all not contour-imparting tool receptacle module components are associated with at least two sets of the tool receptacle module components, that is to say are able to be used for casting two or more different cast parts, and/or one or a plurality of the not contour-imparting tool receptacle module components is associated with all sets of the tool receptacle module components, that is to say able to be used for casting all predefined different cast parts.

In a refinement of the invention, at least one of the not contour-imparting tool receptacle module components is not associated with at least one of the sets of the tool receptacle module components. This refinement thus relates to cases in which not all the not contour-imparting tool receptacle module components are used or required, respectively, for each one of a plurality of cast parts to be cast in combination with the respective contour-imparting mould components.

In a refinement of the invention, the not contour-imparting tool receptacle module components comprise at least one slider component and/or at least one guide component and/or at least one ventilation component and/or at least one centring plate. In this refinement of the invention, the respective tool component, as in terms of the function thereof also used in conventional systems, that is to say the slider component or components, the guide component or components, the ventilation component or components, and the one or a plurality of centring plates thus forms/form in each case one of the not contour-imparting tool receptacle module components and can therefore be correspondingly used in a modular manner for casting different cast parts and/or in different orientations on the base plate.

In a refinement of the invention, the not contour-imparting tool receptacle module components comprise a first, machine type-specific group of one or a plurality of the tool receptacle module components, and a second, machine type-spanning group of one or a plurality of the tool receptacle module components. The machine type-specific group herein is understood to be those not contour-imparting tool receptacle module components which are specified and conceived only for use in a specific type, or a specific machine size, respectively, of the diecasting machine. The machine type-spanning group in contrast is to be understood to be those not contour-imparting tool receptacle module components which can be used in a manner spanning types or sizes, respectively, for different types or sizes, respectively, of the diecasting machine and are correspondingly conceived to this end. The machine type-spanning applicability of this second group of the tool receptacle module components furthermore increases the modularity and thus the flexibility of the diecasting tool system.

In an embodiment of the invention, the at least one guide component and/or the at least one ventilation component and/or the at least one centring plate are/is associated with the first group of not contour-forming tool receptacle module components. This component group, like the base plate, can be established or configured in a machine-related manner.

In an embodiment of the invention, the at least one slider component is associated with the second group of not contour-forming tool receptacle module components. This design embodiment offers, for example, a favourable prerequisite for a machine type-spanning use of one or a plurality of slider components for casting parts in diecasting machines of different types or different machine sizes, respectively, to which end the slider component can be fastened to the base plate which is configured for the respective diecasting machine.

In a refinement of the invention, the single available set of contour-imparting mould components, or at least one of the plurality of available sets of contour-imparting mould components, forms a mould insert which is specified for assembling as a functional unit on the fastening side of the base plate, and on the rear side thereof that faces the base plate has an ejector-related clearance. An ejector plate unit to which one or a plurality of ejector pins are coupled for movement and which by way of an ejector coupling unit is able to be releasably coupled to a base plate-proximal ejector plate actuator unit is capable to be received so as to be axially movable in the ejector-related clearance of this mould insert.

On account of this configuration, the contour-imparting mould component or components of the respective set which for casting an associated cast part is to be assembled on the base plate, can be prepared in advance as a functional unit, that is to say in the case of a plurality of contour-imparting mould components, the latter can be assembled so as to form the corresponding functional unit, or be held together by pre-assembling, respectively, before said contour-imparting mould components as the thus formed functional unit are fastened to the base plate.

The functional unit which in such a manner functions as a mould insert on the side thereof which during the assembling faces the base plate or the fastening side of the latter, respectively, that is to say on the rear side, has the ejector-related clearance, the descriptive reference being intended to indicate that said clearance is related to receiving an ejector component. The mentioned ejector plate unit is in particular able to be received so as to be axially movable in said clearance, wherein the ejector plate unit when assembling this mould insert from the set of contour-imparting mould components on the base plate is releasably coupled to the base plate-proximal ejector plate actuator unit. As the name indicates, the ejector plate actuator unit serves as an actuator unit for activating the ejector plate unit and in a manner known per se is situated so as to be proximal to the base plate, typically behind a rear side of the latter. The ejector pin or ejector pins by way of the axially movable ejector plate unit can be activated by the actuator unit in the desired manner which is likewise known per se.

Overall, this refinement of the invention facilitates the achievement of short tooling times for the diecasting machine, in particular also for a changeover of the set of the contour-imparting mould components when a cast part of another shape and/or size is to be cast. In alternative embodiments it is considered that the contour-imparting mould components are assembled individually on the base plate and/or the ejector plate unit is assembled in a clearance of the base plate.

In an embodiment of the invention, the ejector plate unit is held pre-assembled on the functional unit of the mould insert. This implementation thus very advantageously enables the ejector plate unit to be integrated in the functional unit of the set of contour-imparting mould components to be assembled, and the set of contour-imparting mould components to be assembled as a functional unit, conjointly with the ejector plate unit integrated therein, on the base plate. This enables the ejector plate unit, conjointly with the mould insert functional unit formed by the contour-imparting mould component or mould components, to be assembled on the base plate in one assembling procedure, on account thereof further contributing towards achieving short tooling times in a changeover of the diecasting tool. Alternatively, the ejector plate unit can be assembled on the base plate separately from the contour-imparting mould components, for example prior to the assembling of the contour-imparting mould component or components.

In an embodiment of the invention, the diecasting tool system includes an actuatable retaining bolt unit for releasably fastening the mould insert to the fastening side of the base plate. The use of the actuatable retaining bolt unit enables corresponding automation of the assembling of the mould insert functional unit on the base plate by means of a corresponding actuation of this retaining bolt unit. Alternatively, the assembling of the mould insert functional unit can take place manually, that is to say while using corresponding fastening means which are to be manually handled.

In an embodiment of the invention, the at least one slider component and the associated set of contour-imparting mould components are specified for releasably holding the slider component pre-assembled on the associated mould component or components. This enables advantageous pre-assembling of the slider component or components associated with the assigned set of contour-imparting mould components on the mould component or components of the respective set, this rendering dedicated assembling of the slider component or components on the base plate superfluous. Instead, the functional unit formed from the set of contour-imparting mould components and the slider component or components preassembled thereon can be assembled as an entity on the base plate. This contributes towards achieving short tooling times, in particular also when changing the diecasting tool for another cast part to be cast. Alternatively, the slider component or components can additionally also be established on the base plate in a dedicated manner, or be fastened on the set of contour-imparting mould components on the base plate without pre-assembling.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
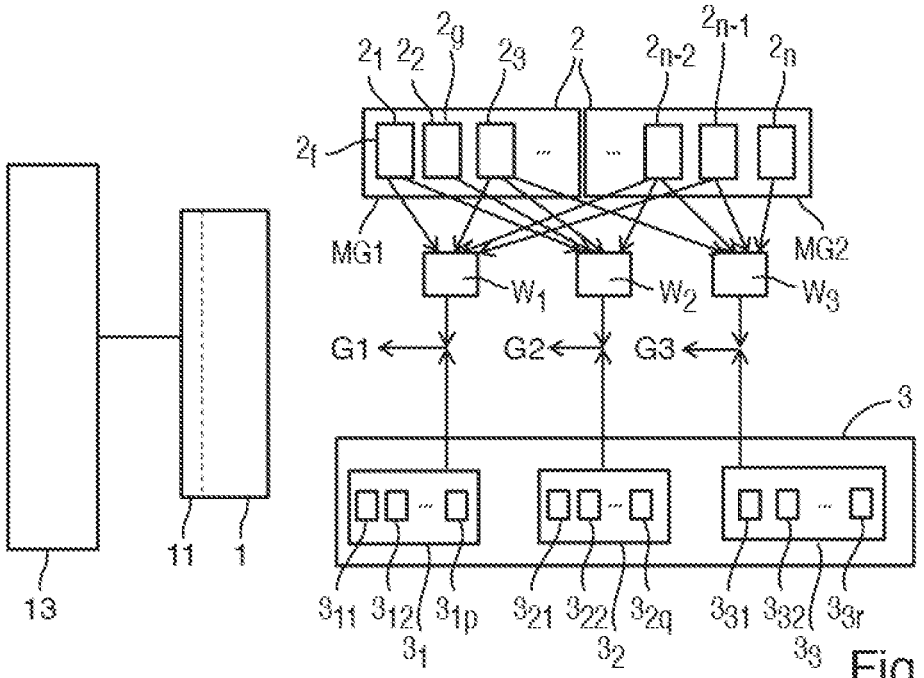
FIG. 1 shows a schematic block diagram illustration of a diecasting tool system.

Embodiments of the diecasting tool system according to the invention shown specifically in FIGS. 1 to 8 and other embodiments thereof will be discussed in more detail hereunder by means of FIGS. 1 to 8. The diecasting tool system is intended and specified for use in a diecasting machine 13 which is schematically indicated in FIG. 1 and serves for casting cast parts by means of diecasting technology. The diecasting machine 13 can in particular be a metal diecasting machine, for example of the cold-chamber or hot-chamber type, for diecasting cast parts from aluminium, magnesium, zinc or another commonplace metal casting material, or alternatively be a plastic injection-moulding machine for producing cast parts from plastics material by means of injection-moulding technology. The diecasting machine 13 herein can be of any machine type or machine construction, respectively, known per se and be of a machine size which is known per se, wherein only the particularities of the diecasting tool system which are specific to the invention have to be discussed here, while reference in terms of other details of the diecasting machine 13 can furthermore be made to the technical knowledge and the prior art. Depending on the embodiment of the system herein, the diecasting tool system according to the invention when required can also be selectively used for different types and/or machine sizes of the diecasting machine 13. As is commonplace, the diecasting machine 13 includes a movable mould half 9 and an immovable mould half 10, the diecasting tool system being disposed thereon or therebetween, respectively, as can be seen from FIG. 2.

As is visualized in the manner of a block diagram in FIG. 1, the diecasting tool system shown therein includes a base plate 1 which is embodied in a machine-related manner, that is to say that the base plate 1 is specified for use or assembly, respectively, on the diecasting machine 13 for which the diecasting tool system is specified. The diecasting tool system furthermore includes at least one first set $\mathbf{3}_1$ of a plurality $\mathbf{3}_{11}$ to $\mathbf{3}_{1p}$ of contour-imparting mould components 3, p being an arbitrary natural of more than one, and a plurality $\mathbf{2}_1$ to $\mathbf{2}_n$ of not contour-imparting tool receptacle module components 2, n being an arbitrary natural of more than one. The number p and the shape of the contour-imparting mould components $\mathbf{3}_{11}$ to $\mathbf{3}_{1p}$ that form the respective set $\mathbf{3}_1$ vary depending on the cast part to be cast. The contour-imparting mould component or components 3 conjointly herein form a mould insert 3 which is presently accordingly identified by the same reference sign, or in their entirety correspond to the mould insert conventionally understood by the person skilled in the art.

The base plate 1, the contour-imparting mould components, or the mould insert 3 formed by the latter, respectively, and the not contour-imparting tool receptacle module components 2 are specified for releasably assembling the respective set $\mathbf{3}_1$ of contour-imparting mould components 3 and an assigned set $W_1$ of tool receptacle module components which are selected from the entirety $\mathbf{2}_1$ to $\mathbf{2}_n$ of the not contour-imparting tool receptacle module components 2 on the base plate 1, more specifically on a fastening side 1*a* of the base plate 1 (opposite a non-fastening rear side 1*b*) which serves this purpose, as can be seen from each of FIGS. 2 to 8, for example, so as to cast a corresponding cast part using the diecasting tool system. To this end, the respective set $\mathbf{3}_1$ of contour-imparting mould components $\mathbf{3}_{11}$ to $\mathbf{3}_{1p}$ in an assembled position on the base plate 1 forms a casting contour 12 for the cast part to be cast. A special embodiment of the casting contour 12 is schematically shown in an exemplary manner in FIGS. 2 to 5.

Figure 2:
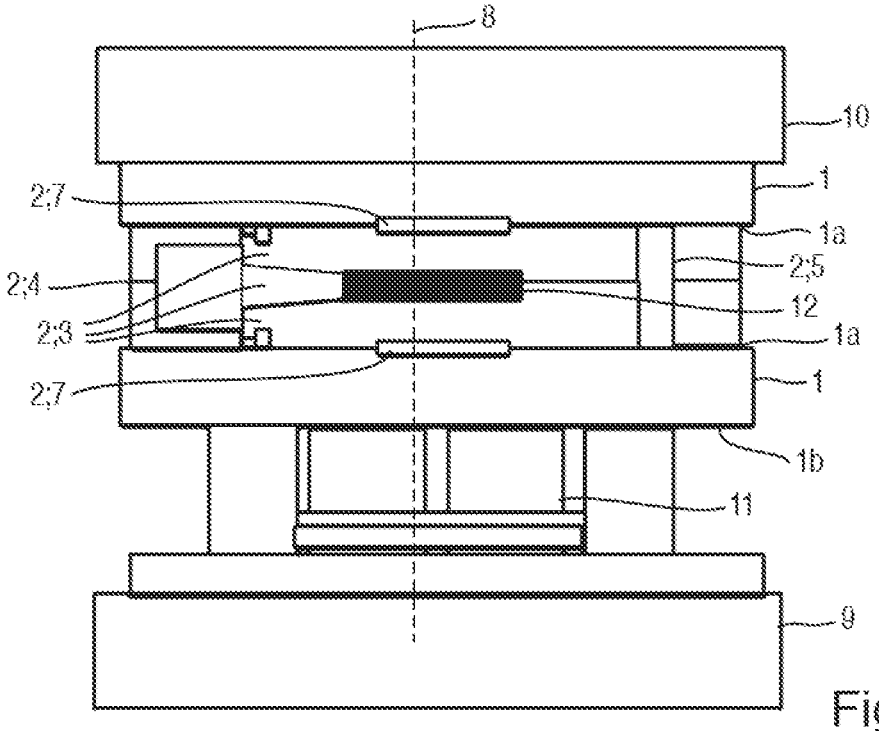
FIG. 2 shows a schematic longitudinal view of a diecasting tool system in the manner of FIG. 1, having selected assembled components for casting a specific cast part.

It is understood that the base plate 1 as well as a set of contour-imparting mould components 3 assembled on said base plate 1 or on the fastening side 1*a* thereof, respectively, and an associated set of the not contour-imparting tool receptacle module components 2 assembled on said base plate 1 or on the fastening side 1*a* thereof, respectively, in the diecasting tool system are in each case typically present once for each of the two mould halves 9, 10 of the diecasting machine 13, as can be seen from the cross-sectional view in the exemplary embodiment of FIG. 2. An ejector mechanism 11 which is schematically indicated in FIG. 2, for example, and is known per se to the person skilled in the art is typically assigned to the base plate 1 which is situated proximal to the movable mould half 9 herein, this therefore not requiring any more detailed explanations.

Figure 3:
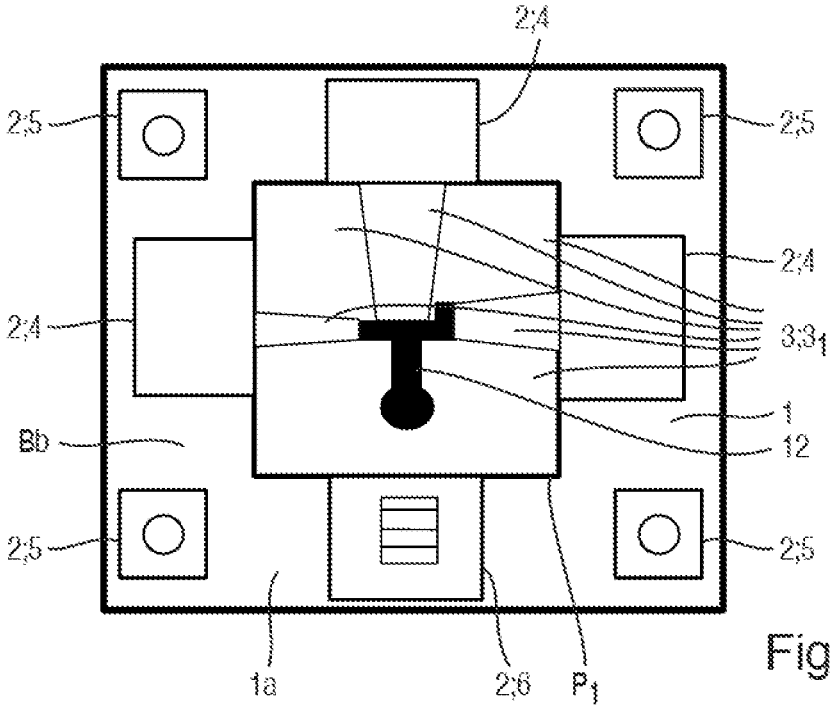
FIG. 3 shows a schematic plan view of the diecasting tool system of FIG. 2 in a first orientation of contour-imparting mould components and not contour-imparting tool receptacle module components on a base plate.
Figure 4:
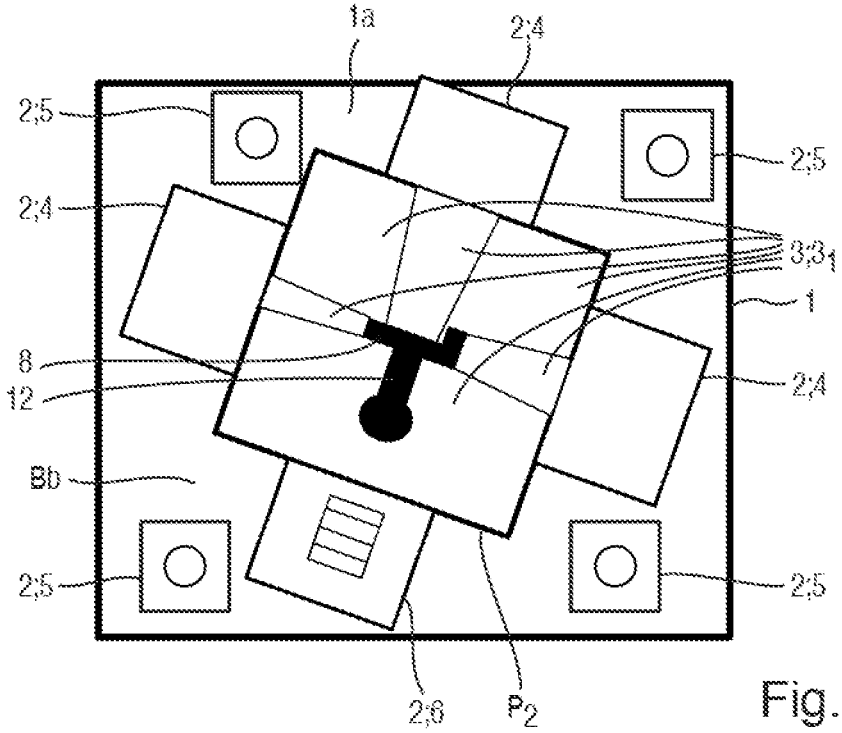
FIG. 4 shows the view of FIG. 3 for a variant in a second orientation, rotated in relation to the first orientation, of the contour-imparting mould components and not contour-imparting tool receptacle module components on the base plate.

The base plate 1 on the fastening side 1*a* thereof includes a fastening grid of a plurality of fastening points 14, in particular fastening bores, as can be seen from FIGS. 3 to 6, which are disposed so as to be distributed in a regular or irregular pattern across a fastening region Bb, wherein the fastening points 14 for the sake of simplicity are not plotted in the views of FIGS. 3 and 4. In the example shown, the fastening region Bb extends substantially across the entire extent of the fastening side 1*a*; alternatively, said fastening region Bb extends only across a sub-region of said fastening side 1*a*, for example only across a central region of the area of the fastening side 1*a*, having in terms of area an extent of, for example, at most 50 to 80% of the area of the fastening side 1*a*. The fastening bores 14 can receive fastening bolts or other fastening means which are conventionally used for fastening purposes in diecasting tools.

In corresponding embodiments of the diecasting tool system according to the invention, the contour-imparting mould components $\mathbf{3}_{11}$ to $\mathbf{3}_{1p}$ of the single, first set $\mathbf{3}_1$ of contour-imparting mould components 3, or at least of the first set $\mathbf{3}_1$ of a plurality of sets $\mathbf{3}_1$, $\mathbf{3}_2$, $\mathbf{3}_3$ of contour-imparting mould components 3, respectively, and the assigned set $W_1$ of the not contour-imparting tool receptacle module components 2 are able to be assembled in at least two different orientations and/or in at least two displaced positions on the base plate 1. To this end, FIGS. 2 and 3 visualize a first variant of assembly, and FIGS. 4 and 5 a second variant of assembly in which a first orientation $P_1$, as can be seen in particular from FIG. 3, differs from a second orientation $P_2$, as can be seen from FIGS. 4 and 5. The term orientation herein means the spatial position and in particular the rotary position of the contour-imparting mould components 3 and of the assigned set $W_1$ of the not contour-imparting tool receptacle module components 2 relative to the base plate 1.

Said different orientations $P_1$, $P_2$, or positionings, respectively, herein are to be understood such that at least one of the components to be assembled on the base plate 1, that is to say at least one of the contour-imparting mould components 3 and of the not contour-imparting tool receptacle module components 2, can be disposed in a correspondingly different orientation or displaced positioning, respectively, on the base plate 1, wherein all other components, depending on the requirement and the specific application, can in each case likewise be assembled so as to be differently oriented or positioned, respectively, or in the same orientation or position, respectively, on the base plate 1. The different orientation or position, respectively, at least for the contour-imparting mould components 3 is typically implemented so as to form the casting contour 12 formed by the latter in a correspondingly different orientation or position, respectively, on the base plate 1. In many instances, one or a plurality of the not contour-imparting tool receptacle module components 2 are moreover able to be assembled in a different orientation or position, respectively, on the base plate 1.

The contour-imparting mould components 3 are individually adapted to the cast part to be cast, while the not contour-imparting tool receptacle module components 2 do not participate in determining the casting contour 12 for the cast part to be cast and therefore, depending on the embodiment of the system, can be resorted to in a variable and flexible manner for assembling a complete tool construction for the respective cast part. The tool receptacle module components for forming the respective set $W_1$ used for casting the respective cast part herein are suitably selected from the entirety $\mathbf{2}_1$ to $\mathbf{2}_n$ of all not contour-imparting tool receptacle module components 2. The not contour-imparting tool receptacle module components 2 can inter alia serve for supporting the secure mounting of the contour-imparting mould components 3 on the base plate, for example by way of suitable form-fitting and/or force-fitting connections between the not contour-imparting tool receptacle module components, on the one hand, and the contour-imparting mould components 3, on the other hand, such that the required strength and dimensional stability of the tool components assembled in a modular manner on the base plate, including the contour-imparting mould components 3, in relation to the compressive stresses arising during the casting procedure is ensured.

As has already been mentioned, in corresponding embodiments of the invention a plurality of sets $\mathbf{3}_1$, . . . of contour-imparting mould components $\mathbf{3}_{11}$ to $\mathbf{3}_{1p}$, . . . for selectively assembling on the base plate 1 are present conjointly with in each case one assigned set $W_1$, $W_2$, $W_3$ of tool receptacle module components selected from the entirety $\mathbf{2}_1$ to $\mathbf{2}_n$ of the not contour-imparting tool receptacle module components 2, such that a corresponding plurality of different cast parts can be cast by the diecasting tool system while using the same base plate 1. To this end, an embodiment of the system which, in addition to the first set $\mathbf{3}_1$ of contour-imparting mould components $\mathbf{3}_{11}$ to $\mathbf{3}_{1p}$, includes two further sets $\mathbf{3}_2$, $\mathbf{3}_3$ of contour-imparting mould components $\mathbf{3}_{21}$ to $\mathbf{3}_{2q}$, or $\mathbf{3}_{31}$ to $\mathbf{3}_{3r}$, q and r being arbitrary naturals of more than one, for selectively assembling on the base plate 1 conjointly with in each case one assigned set $W_1$, $W_2$, $W_3$ of the tool receptacle module components 2 for casting a first cast part G1, a second cast part G2, or a third cast part G3, respectively, is shown in FIG. 1. In other embodiments, the diecasting tool system comprises only one or two sets, for example the sets $\mathbf{3}_1$ and $\mathbf{3}_2$, or more than three sets, of contour-imparting mould components 3 and in each case a corresponding number of assigned sets $W_1$, . . . of the tool receptacle module components 2.

Figure 5:
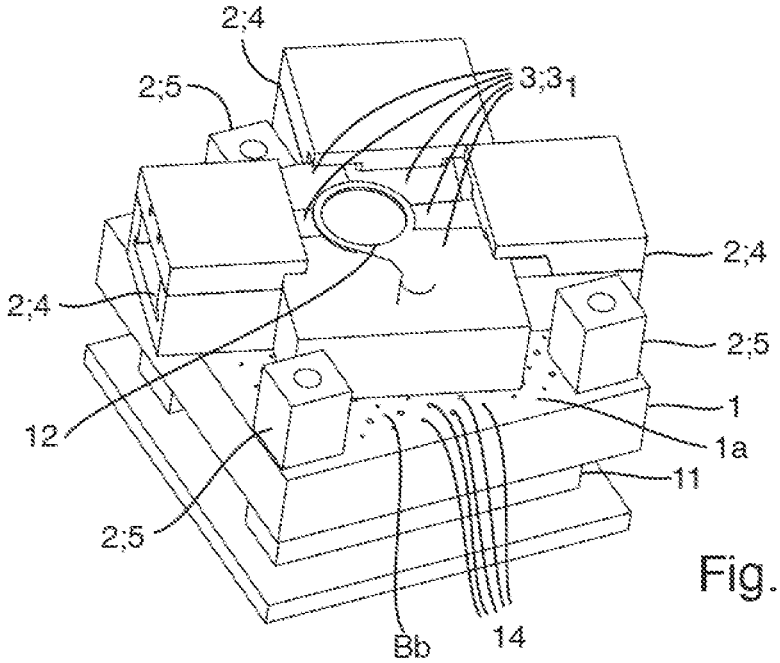
FIG. 5 shows a schematic perspective view of the variant of FIG. 4.
Figure 6:
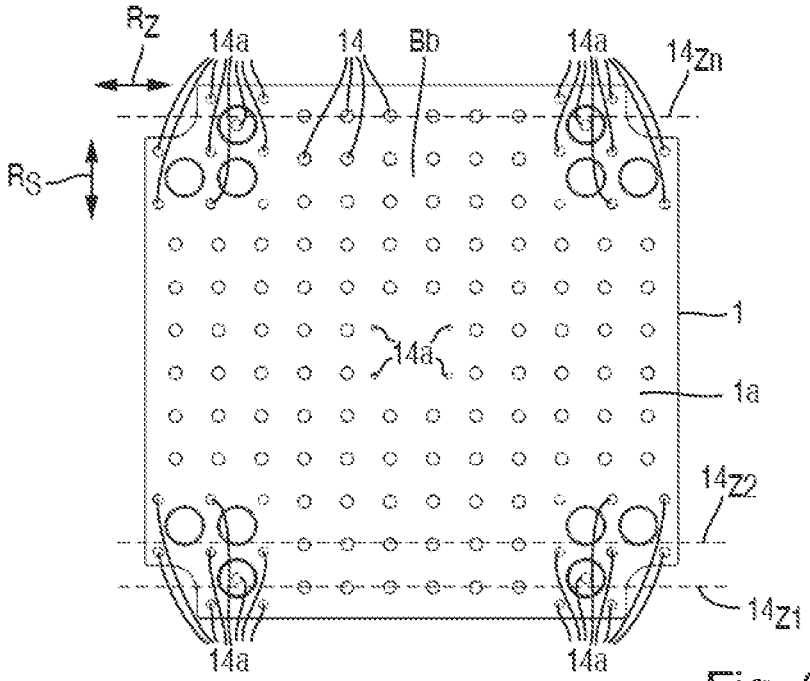
FIG. 6 shows a plan view of a fastening side of a base plate as can be used, for example, for the variants of FIGS. 3 and 4.

In advantageous embodiments, the fastening grid is formed by a two-dimensional field of the fastening points 14, as in the shown example of FIG. 6, in which the fastening points 14 are disposed so as to be mutually spaced apart in a plurality of rows $\mathbf{14}_{Z1}$, $\mathbf{14}_{Z2}$, . . . , $\mathbf{14}_{Zn}$ which run in parallel in a row direction Rz, wherein the rows $\mathbf{14}_{Z1}$, $\mathbf{14}_{Z2}$, . . . , $\mathbf{14}_{Zn}$ are mutually spaced apart in a row spacing direction Rs which is not parallel to the row direction Rz. As can be seen from FIGS. 5 and 6, the row direction Rz and the row spacing direction Rs in the example shown are in particular mutually perpendicular, that is to say that the fastening points 14 are disposed in rows and columns, so to speak. In the example shown, the fastening points 14 of in each case two neighbouring rows are disposed so as to be centrically offset, that is to say so as to be offset by approximately half the spacing thereof in the row direction Rz. In alternative embodiments, the row direction Rz and the row spacing direction Rs run so as to be mutually oblique, and/or the fastening points 14 of in each case two neighbouring rows are disposed so as not to be offset or in any case not centrically offset. Optionally, additional fastening points 14, such as fastening points 14*a* which are shown in an exemplary manner in FIG. 6, can be provided in addition to the rows mentioned, or outside the latter, respectively, depending on the requirement. Likewise, some of the fastening points 14 shown in FIG. 6 can optionally be absent in one or a plurality of the rows, that is to say that not all the fastening points 14 have to be mandatorily disposed at a mutual identical space within a respective row.

The assembling of the various components on the base plate 1 can take place while using screw connections, for example, to which end the base plate 1 in corresponding implementations is provided with a regular or irregular pattern of fastening bores which can receive threaded bolts or similar fastening bolts by way of which the respective tool component is releasably fastened to the base plate 1 in the desired position or orientation, respectively.

In corresponding embodiments of the diecasting tool system according to the invention, at least two sets $\mathbf{3}_1$, $\mathbf{3}_2$ of contour-imparting mould components 3 and accordingly at least two assigned sets $W_1$, $W_2$, . . . of the entirety $\mathbf{2}_1$ to $\mathbf{2}_n$ of the not contour-imparting tool receptacle module components 2 are present in such a manner that at least one of the not contour-imparting tool receptacle module components 2 is associated with at least two of the sets $W_1$, $W_2$, . . . of the not contour-imparting tool receptacle module components $\mathbf{2}_1$ to $\mathbf{2}_n$. FIG. 1 thus in an exemplary manner visualizes a case in which a not contour-imparting tool receptacle module component $\mathbf{2}_f$ in the form of the module component $\mathbf{2}_1$ is associated with the set $W_1$ used for casting the first cast part G1 and with the set $W_2$ of the not contour-imparting tool receptacle module components 2 used for casting the second cast part G2. In a similar manner, the module component $\mathbf{2}_{n-1}$ is associated with the first and the third set $W_1$, $W_3$ of the not contour-imparting tool receptacle module components 2 for casting the first and third cast part G1, G3, respectively, and the module components $\mathbf{2}_3$ and $\mathbf{2}_{n-2}$ are in each case associated with all three sets $W_1$, $W_2$, $W_3$ of the not contour-imparting tool receptacle module components 2 for casting the first, second and third cast part G1, G2, G3, respectively.

In corresponding embodiments, at least one not contour-imparting tool receptacle module component is not associated with at least one of the sets $W_1$, $W_2$, $W_3$ of the tool receptacle module components 2 for casting a respective associated cast part. In FIG. 1, a module component $\mathbf{2}_g$ in the form of the module component 22 is thus not associated with the set $W_1$ of the not contour-imparting tool receptacle module components 2 used for casting the first cast part G1, and is also not associated with the third set $W_3$ but is only associated with the second set $W_2$. In the exemplary embodiment of FIG. 1, the module component $\mathbf{2}_1$ in an analogous manner is associated only with the first and the second set $W_1$, $W_2$ and not with the third set $W_3$, the module component $\mathbf{2}_{n-1}$ is associated only with the first and the third set $W_1$, $W_3$ and not with the second set $W_2$, and the module component $\mathbf{2}_n$ is associated only with the third set $W_3$ but not with the first and the second set $W_1$, $W_2$ of the tool receptacle module components 2.

In corresponding embodiments, the entirety $\mathbf{2}_1$ to $\mathbf{2}_n$ of not contour-imparting tool receptacle module components 2 comprises at least one slider component 4 and/or at least one guide component 5 and/or at least one ventilation component 6 and/or at least one centring plate 7. Implementations in which a plurality of slider components 4, a plurality of guide components 5, a ventilation component 6 and a plurality of centring plates 7 are used as not contour-imparting tool receptacle module components are illustrated in an exemplary manner in FIGS. 2 to 5.

In corresponding embodiments herein, at least one centring plate 7 and a plurality of the contour-imparting mould components 3 which are associated with the respective cast part are in each case assembled on each of the two base plates 1 for the movable mould half 9 and the fixed mould half 10, as can be seen in the example of FIG. 2. Often, one or a plurality of the slider components 4 and likewise one or a plurality of the guide components 5 are in each case assembled on each of the two base plates 1.

In advantageous implementations of the diecasting tool system, the entirety $\mathbf{2}_1$ to $\mathbf{2}_n$ of not contour-imparting tool receptacle module components 2 comprises a first, machine type-specific group MG1 of one or a plurality of the not contour-imparting tool receptacle module components 2, and a second machine type-spanning group MG2 of one or a plurality of the not contour-imparting tool receptacle module components 2. FIG. 1 visualizes an example having in each case a plurality of the not contour-imparting tool receptacle module components 2 in each of the two groups MG1, MG2. Those not contour-imparting tool receptacle module components which are specially conceived for use in a specific machine type or a specific machine size, respectively, of the diecasting machine 13 are associated with the machine type-specific group MG1. Those not contour-imparting tool receptacle module components which can be used in two or more different machine types or machine sizes of the diecasting machine 13 are associated with the machine type-spanning group MG2, to which end said tool receptacle module components are in particular conceived for being assembled on the respective base plate 1 thereof and meeting the respective casting conditions, for example withstanding the respective compressive stresses during the casting procedure.

In corresponding implementations, the one or the plurality of guide components 5 and/or the ventilation component or components 6 and/or the one or the plurality of centring plates 7 are associated with the machine type-specific group MG1 of the not contour-imparting tool receptacle module components 2, and/or the slider component or components 4 are associated with the group MG2 of the not contour-imparting tool receptacle module components 2 that can be used in a machine type-spanning manner.

As can be seen in particular by means of FIGS. 3 to 5, in the two system variants with different assembly orientations shown there in which the contour-imparting mould components 3 are in particular assembled on the base plate 1, the two different orientations $P_1$, $P_2$ are rotated in relation to one another about an axis 8 which is perpendicular to the base plate 1. The axis 8, as in the example shown, is preferably situated within the fastening region Bb, as can be seen from FIGS. 2 and 4. In the case of FIG. 3, the orientation $P_1$ is aligned so as to be parallel to the sides of the base plate 1 and thus parallel to the horizontal or vertical, respectively, machine direction of the diecasting machine 13; in the case of FIGS. 4 and 5, the orientation $P_2$ at least of the contour-imparting mould components 3 is oblique to the sides of the base plate 1. When required, this can be used for forming the casting contour 12 in a spatial position on the base plate 1 which is favourable with a view to optimizing the relevant casting parameters, in that the associated set $\mathbf{3}_1$, $\mathbf{3}_2$, . . . of contour-imparting mould components $\mathbf{3}_{11}$ to $\mathbf{3}_{1p}$, $\mathbf{3}_{21}$ to $\mathbf{3}_{2q}$, . . . is correspondingly assembled. Moreover, the displacement directions of slider guides of the slider components 4 can also be optimally chosen so as to match the shape of the cast part G1, G2, . . . to be cast, or the casting contour 12, respectively, in that the slider components 4 are assembled in the corresponding orientation on the base plate 1, for example.

Figure 7:
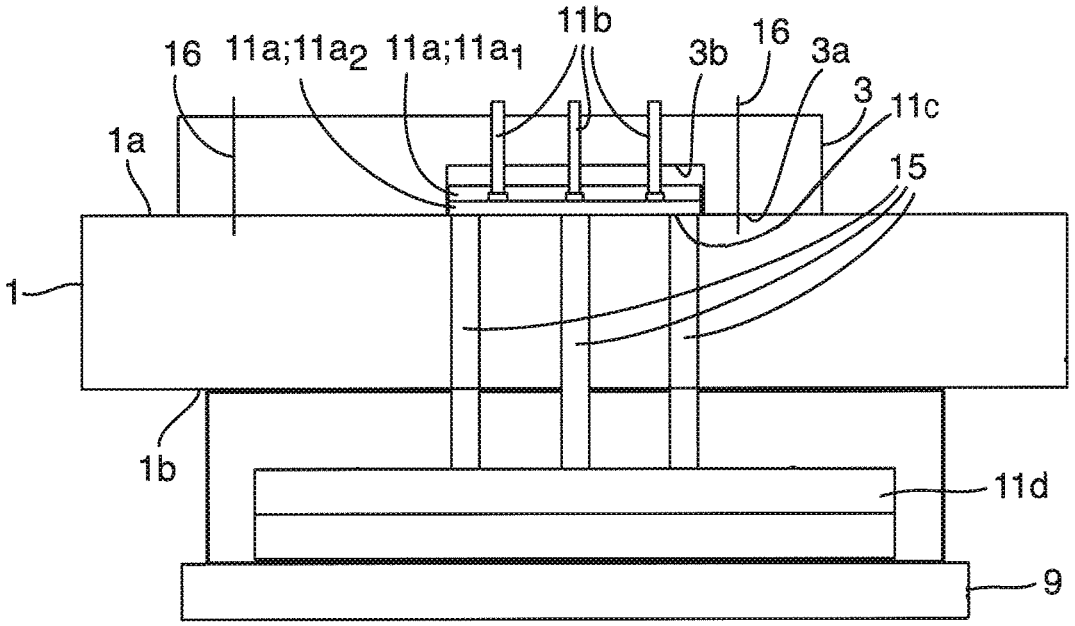
FIG. 7 shows a schematic longitudinal view of part of a diecasting tool system in the manner of FIG. 1 that is assigned to a movable mould half, in an embodiment having an ejector plate unit which can be received in a mould insert and having select assembled components.

In advantageous embodiments, at least one of the sets $\mathbf{3}_1$ of contour-imparting mould components $\mathbf{3}_{11}$ to $\mathbf{3}_{1p}$ forms a mould insert 3 which is specified for assembling as a functional unit on the fastening side 1*a* of the base plate 1, and on the rear side 3*a* thereof that faces the base plate 1 has an ejector-related clearance 3*b*, wherein said base plate 1 in this case is typically the base plate 1 which is provided for the movable mould half because the ejection of the cast part usually takes place there, as has already been mentioned above in the context of the ejector mechanism 11. An embodiment of this type is illustrated in FIG. 7. An ejector plate unit 11*a* to which one or a plurality of ejector pins 11*b* are coupled for movement is able to be received so as to be axially movable in the ejector-related clearance 3*b* of this mould insert 3.

The ejector plate unit 11*a* by way of an ejector coupling unit 11*c* is able to be releasably coupled to a base plate-side ejector plate actuator unit 11*d*. This means that the ejector plate unit 11*a* and thus the ejector pin or pins 11*b*, in the case of a mould insert 3 assembled on the base plate 1, are releasably coupled to the ejector plate actuator unit 11*d* and on account thereof are able to be driven by the ejector plate actuator unit 11*d* in order to carry out the desired axial ejector movement, this corresponding to the ejector mechanism 11 mentioned in the context of FIG. 2.

The ejector-related clearance 3*b* can also be referred to as a so-called ejector box and contains all ejector components which are required for ejecting the cast part, to which end an axial lifting movement which is sufficient for reliably ejecting the cast part is provided for the axial movement. In the example shown, the ejector pins 11*b* by way of a mushroom-shaped head end are fixed between two thin ejector plates 11*a*1, 11*a*2 which form the ejector plate unit 11*a*. On account thereof, it is enabled in a simple manner that, in the case of a plurality of ejector pins 11*b* as in the example shown, all ejector pins 11*b* can be simultaneously displaced in an axial manner. The ejector coupling unit 11*c* is implemented in a manner which is known per se to the person skilled in the art, this not requiring any further explanation here, and enables the desired coupling of the ejector plate unit 11*a* to the ejector plate actuator unit 11*d* while assembling the mould insert 3 on the base plate 1. The translation of the axial drive movement, or of the associated axial ejector forces, respectively, from the ejector plate actuator unit 11*d*, which is preferably formed by a conventional universal ejector plate pack having a usual interface to a machine-proximal hydraulic system, in the example shown takes place by pushrods 15. The ejector coupling unit 11*c* is preferably specified so as to be able to be controlled from the insert side of the diecasting tool system and is preferably equipped with a suitable control intelligence which for this specific application is known per se to the person skilled in the art. For improved understanding it is to be mentioned that said insert side of the system in the view of FIG. 7 lies at the top, and the rear side of the diecasting tool system facing away therefrom lies at the bottom. The ejector coupling unit 11*c* is in particular specified for automatically establishing or releasing, respectively, the coupling between the ejector plate unit 11*a* and the ejector plate actuator unit 11*d* simultaneously with assembling or releasing the mould insert 3 on or from the base plate 1, respectively.

In advantageous implementations, the ejector plate unit 11*a* is able to be preassembled on the functional unit of the mould insert 3, and can in this manner be held preassembled on the latter before the mould insert 3, in this case conjointly with the ejector plate unit 11*a*, is assembled on the base plate 1, as is also the case in the exemplary embodiment of FIG. 7.

The assembling and releasing of the mould insert 3 on or from, respectively, the fastening side 1*a* of the base plate 1 in corresponding embodiments, as in the shown example of FIG. 7, can take place while using an actuatable retaining bolt unit 16. To this end, an implementation for the holding bolt unit 16 preferably having a plurality of retaining bolts which are to be attached and released in a correspondingly automated controllable manner can be used, as is known per se to the person skilled in the art and only schematically indicated in FIG. 7.

Figure 8:
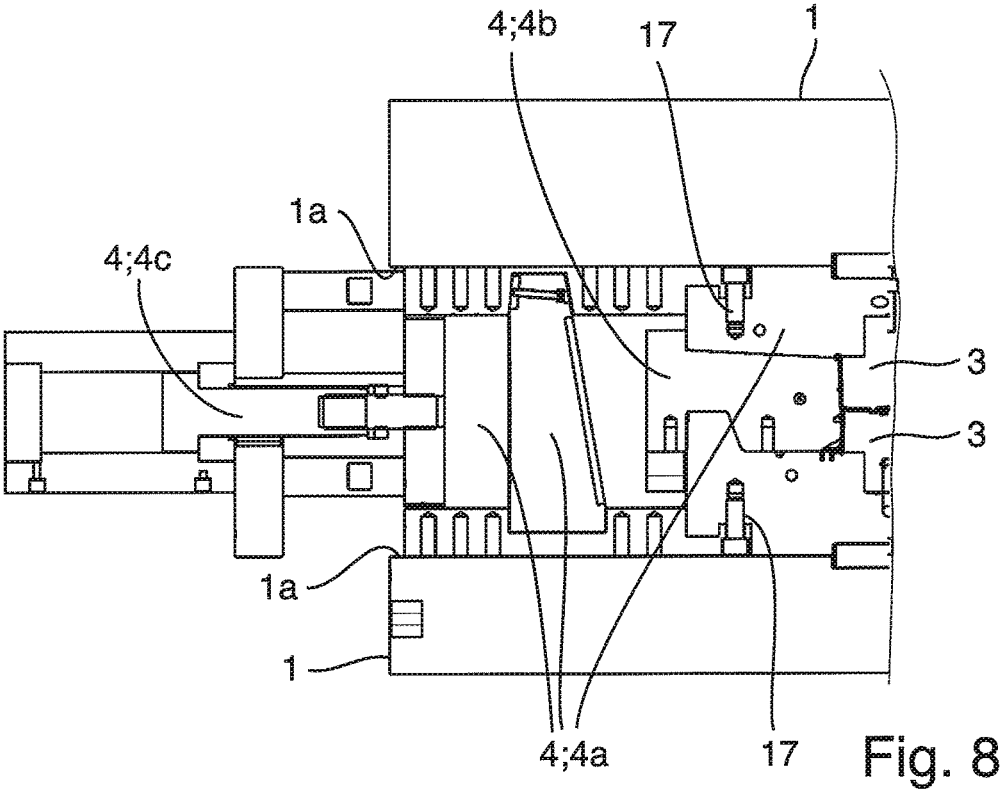
FIG. 8 shows a schematic longitudinal view along half a diecasting tool system in the manner of FIG. 1, in an embodiment in which a slider is preassembled, and having selected assembled components.

In advantageous embodiments, the at least one slider component 4 and the associated set, for example the set $\mathbf{3}_1$, of contour-imparting mould components, for example the mould components $\mathbf{3}_{11}$ to $\mathbf{3}_{1p}$, are specified for releasably holding the slider component 4 pre-assembled on the associated mould component or components, that is to say the mould insert 3 formed by the latter, as is visualized in an implementation according to FIG. 8. Especially to this end, a slider hydraulic unit 4*c* and further slider standard functional groups 4*a*, in particular in the form of guiding and locking components, as well as a slider attachment 4*b*, which likewise in a usual manner is embodied so as to be contour-imparting in a manner individual to the cast part and to this end interacts with the assembled set $\mathbf{3}_1$ of contour-imparting mould components, that is to say with the mould insert 3 which is assembled for the cast part to be cast, are shown for the at least one slider component 4 as slider component parts, which are known per se to the person skilled in the art, in the fragmented sectional view of FIG. 8. In a manner analogous to FIG. 2, the base plates 1 for the fixed as well as the movable mould half and the associated mould insert 3, the latter being in each case assembled on the fastening side 1*a* of said base plates 1, are shown in fragments in FIG. 8.

Said slider components and thus the slider component or components 4 in the example shown of FIG. 8 are overall connected to the respective mould insert 3 and additionally screw-fitted thereto by means of a respective anchoring cam 17 and assigned screw connections. On account thereof, additional fixing of the respective slider component 4 on the respective base plate 1, or the basic construction of the system, which proximal to the insert terminates at the respective base plate 1, respectively, is not required. Rather, the respective slider component 4 during the operation of the diecasting machine or of the diecasting tool system, respectively, can be supported in a self-acting manner on corresponding support face regions on the fastening side 1*a* of the respective base plate 1, so as to absorb pressure and compressive forces resulting therefrom during the mould filling procedure. On the other hand, the pre-assembling of the slider component or components 4 on the mould insert or inserts 3, or the set $\mathbf{3}_1$ of contour-imparting mould components $\mathbf{3}_{11}$ to $\mathbf{3}_{1p}$ that in each case form said mould insert 3, respectively, enables rapid tooling of the diecasting machine with the components of the diecasting tool system that are required for casting the respective desired cast part, without the basic construction of the system, that is to say the respective base plate 1 and the system components adjoining the latter on the rear side, having to be disassembled from that diecasting machine to this end.

In corresponding embodiments, the invention moreover enables comparatively rapid and simple tooling and retooling of the diecasting machine when cast parts of another shape and/or size are to be cast. It suffices to this end that the respective set of contour-imparting mould components and the associated tool receptacle module components are assembled or disassembled, respectively, while the basic construction of the diecasting tool system, including the base plates, can be left unchanged. The entire tooling or retooling procedure, respectively, for changing tools when a cast part of another shape is to be cast, can take place completely from the insert side of the tool system, or the diecasting machine, respectively, without interventions for disassembling the basic construction, or assembling or disassembling measures on the basic construction, respectively, being required. The set of contour-imparting mould components in corresponding implementations can be provided so as to be pre-assembled, when required so as to include associated ejector components and slider components, and the functional unit thus formed can be incorporated as an entity in the diecasting machine and be assembled and fixed on the respective base plate from the tool insert side, preferably in an automated or partially automated manner and while using a corresponding actuatable retaining bolt unit with retaining bolts or alternative fastening means which are to be attached and released in an automated manner.

As is highlighted by the exemplary embodiments shown and explained further above, the invention makes available an advantageously modular diecasting tool system which enables a modular and thus flexible and variable use of tool components which for casting cast parts of different shapes and/or in a different orientation of the casting contour in terms of the machine directions of the diecasting machine are able to be assembled on a base plate. On account thereof, the invention offers advantages in particular also for the casting of prototypes and the low-volume production of cast parts.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A diecasting tool system for a diecasting machine for casting cast parts, comprising:

a machine-related base plate;

at least one set of contour-imparting mould components which in an assembled position on the base plate form a casting contour for an associated cast part to be cast; and a plurality of not contour-imparting tool receptacle module components;

wherein the base plate, the not contour-imparting tool receptacle module components and the contour-imparting mould components are configured for releasably assembling an associated set of contour-imparting mould components and an assigned set of the not contour-imparting tool receptacle module components on a fastening side of the base plate to cast the associated cast part;

wherein the base plate on the fastening side comprises a fastening grid of a plurality of fastening points which are disposed so as to be distributed in a regular or irregular pattern across a fastening region; and wherein the at least one set of contour-imparting mould components, conjointly with the assigned set of the not contour-imparting tool receptacle module components, is capable to be assembled in at least two different orientations or at least two mutually displaced positions on the fastening side of the base plate, or wherein the at least one set of contour-imparting mould components is a plurality of sets of contour-imparting mould components for selective assembling of different ones of the plurality of sets of the contour-imparting components to the fastening side of the base plate, each set of the contour-imparting mould components being associated with a respectively assigned set of the not contour-imparting tool receptacle module components.

2. The diecasting tool system according to claim 1, wherein the fastening grid is formed by a two-dimensional field of the fastening points in which field the fastening points are disposed in a plurality of successive parallel rows which are mutually spaced apart in a row spacing direction which is non-parallel to a row direction.

3. The diecasting tool system according to claim 1, wherein a first and a second of the at least two different orientations are rotated in relation to one another about an axis which is perpendicular to the base plate and is situated within the fastening region.

4. The diecasting tool system according to claim 1, wherein at least one of the not contour-imparting tool receptacle module components is associated with at least two of the sets of the tool receptacle module components.

5. The diecasting tool system according to claim 1, wherein at least one of the not contour-imparting tool receptacle module components is not associated with at least one of the sets of the tool receptacle module components.

6. The diecasting tool system according to claim 1, wherein the not contour-imparting tool receptacle module components comprise at least one of: at least one slider component, at least one guide component, at least one ventilation component, or at least one centring plate.

7. The diecasting tool system according to claim 6, wherein the at least one slider component and the associated set of contour-imparting mould components are configured for releasably holding the at least one slider component pre-assembled on the associated set of contour-imparting mould components.

8. The diecasting tool system according to claim 1, wherein the not contour-imparting tool receptacle module components comprise a first, machine-specific group of one or a plurality of the not contour-imparting tool receptacle module components and a second, machine-spanning group of one or a plurality of the not contour-imparting tool receptacle module components.

9. The diecasting tool system according to claim 8, wherein the not contour-imparting tool receptacle module components comprise at least one of: at least one slider component, at least one guide component, at least one ventilation component, or at least one centring plate.

10. The diecasting tool system according to claim 9, wherein the at least one guide component is associated with the first group.

11. The diecasting tool system according to claim 9, wherein the at least one ventilation component is associated with the first group.

12. The diecasting tool system according to claim 9, wherein the at least one centring plate is associated with the first group.

13. The diecasting tool system according to claim 9, wherein the at least one slider component is associated with the second group.

14. The diecasting tool system according claim 1, wherein the set or at least one of the sets of contour-imparting mould components forms a mould insert which is configured for assembling as a functional unit on the fastening side of the base plate, and on a rear side thereof that faces the base plate has an ejector-related clearance; and an ejector plate unit, to which one or a plurality of ejector pins are coupled for movement and which by way of an ejector coupling unit is capable of being releasably coupled to a base plate-side ejector plate actuator unit, is capable of being received so as to be axially movable in the ejector-related clearance of the mould insert.

15. The diecasting tool system according to claim 14, wherein the ejector plate unit is held pre-assembled on the functional unit of the mould insert.

16. The diecasting tool system according to claim 14, further comprising:

an actuatable retaining bolt unit for releasably fastening the mould insert to the fastening side of the base plate.

* * * * *